US005807169A

United States Patent [19]

Martin et al.

[11] Patent Number: 5,807,169

[45] Date of Patent: Sep. 15, 1998

[54] OSCILLATING HAND TOOL

[75] Inventors: Michael Martin, Darlington; Colin Pugh, Wingate; Daniel Bone, Durham, all of United Kingdom

[73] Assignee: Black & Decker Inc., Newark, Del.

[21] Appl. No.: 560,775

[22] Filed: Nov. 21, 1995

[30] Foreign Application Priority Data

Nov. 25, 1994 [GB] United Kingdom ..... 9423848

[51] Int. Cl.[6] ..... B24B 23/04

[52] U.S. Cl. ..... 451/357; 451/351; 451/344; 451/294

[58] Field of Search ..... 451/351, 357, 451/344, 294

[56] References Cited

U.S. PATENT DOCUMENTS

| | | | |
|---|---|---|---|
| 3,287,859 | 11/1966 | Leveque . | |
| 4,660,329 | 4/1987 | Hutchins . | |
| 4,833,938 | 5/1989 | Reinwall et al. . | |
| 5,018,314 | 5/1991 | Fushiya et al. | 451/344 |
| 5,384,984 | 1/1995 | Smith | 451/357 |
| 5,392,568 | 2/1995 | Howard, Jr. et al. | 451/357 |
| 5,425,666 | 6/1995 | Frank et al. | 451/357 |
| 5,443,414 | 8/1995 | Haney | 451/166 |
| 5,453,040 | 9/1995 | Schaal et al. | 451/357 |
| 5,458,533 | 10/1995 | Barth et al. | 451/357 |
| 5,496,207 | 3/1996 | Hornung et al. | 451/357 |
| 5,511,271 | 4/1996 | Shishido et al. | 451/351 |

FOREIGN PATENT DOCUMENTS

| | | |
|---|---|---|
| 0541275 | 5/1993 | European Pat. Off. . |
| 2255999 | 7/1975 | France . |
| 4226741 | 2/1994 | Germany . |
| 1381749 | 1/1975 | United Kingdom . |
| 2273900 | 7/1994 | United Kingdom . |
| 9009869 | 9/1990 | WIPO . |

*Primary Examiner*—Robert A. Rose
*Assistant Examiner*—George Nguyen
*Attorney, Agent, or Firm*—Bruce S. Shapiro; Dennis A. Dearing; John D. Del Ponti

[57] ABSTRACT

The invention provides a braking system for a powered oscillating hand tool which tool comprises (i) a housing; (ii) a drive unit (2) having an electric motor (4) and a drive shaft (8); (iii) a bearing (28) mounted on the drive shaft (8) and located radially eccentrically relative to the drive shaft (8), adapted to drive a second drive shaft (26); (iv) means (22) for mounting an oscillating head (24) on the second drive shaft (26) and (v) brake means (30) for providing braking between the oscillating head (24) and the housing (6). The brake means (30) comprises (i) a reaction surface (35, 46); (ii) a resilient support member (32, 40) formed from a resilient material which material, under compression, provides a resultant load on the contact surface and (iii) an abrasion resistant contact layer (34, 44) mounted on the support member (32, 40).

10 Claims, 2 Drawing Sheets

OSCILLATING HAND TOOL

Figure 1:
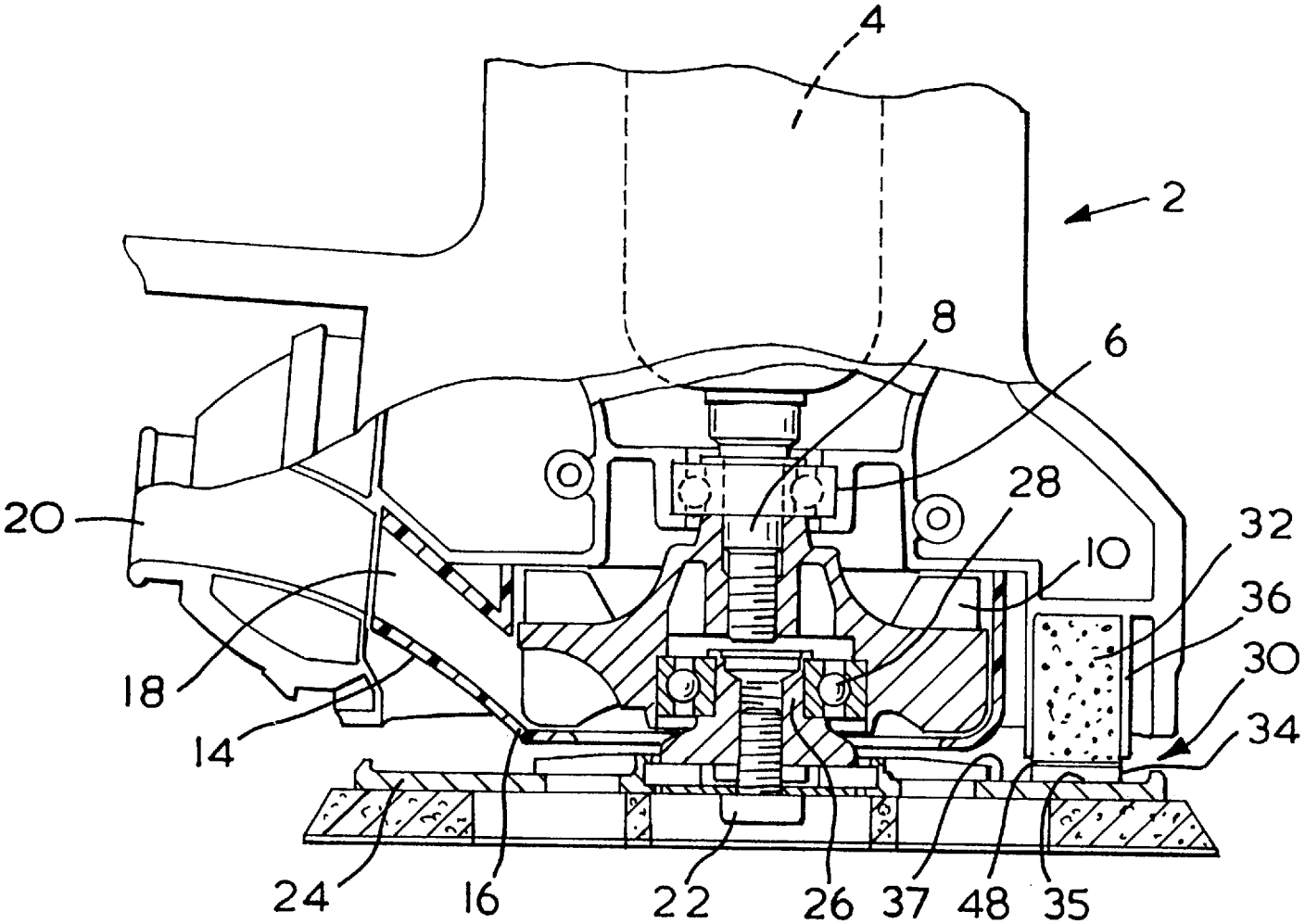

The present invention relates to a braking system for a powered oscillating hand tool, comprising a drive unit having an electric motor with a drive shaft to which an oscillating head, in particular a sander head, can be attached. The braking system is particularly suitable for use for braking a random orbit sander.

In a random orbit sander, a circular platen is driven by a drive system which comprises an eccentric bearing so that the platen can spin independently of the motor, and the platen describes a random orbit. Such sanders are in general used for the removal of relatively large quantities of material. It is known to provide braking in random orbit sanders, in which a brake which is mounted in the housing is in constant contact with the sanding platen, which brake operates in two ways. When the sander is in use, the brake acts a platen speed limiter, operating in particular to prevent scratches when the unit is placed on and taken off the work surface. Secondly, when the unit is switched off, the stop time is very much reduced.

It is a disadvantage of known braking systems of this type, that they consist of a relatively complex spring and leg design which is expensive to manufacture and has to be sealed against dust ingress.

It is an object of the present invention to provide a powered oscillating hand tool in which the above disadvantages are reduced or substantially obviated.

The present invention provides a braking system for a powered oscillating hand tool which tool comprises (i) a housing (ii) a drive unit having an electric motor and a drive shaft;

(iii) a bearing mounted on the drive shaft and located radially eccentrically relative to the drive shaft, and adapted to drive a second drive shaft;

(iv) means for mounting an oscillating head on the second drive shaft and (v) brake means for providing braking between the oscillating head and the housing characterised in that the brake means comprises (vi) a reaction surface (vii) a resilient support member formed from a resilient material which material, under compression, provides a resultant load on the contact surface and (viii) an abrasion resistant contact layer mounted on the support member.

In a preferred embodiment of a braking system according to the invention, the powered hand tool comprises a random orbit sander and the oscillating head comprises a sanding platen.

The braking means may be in the form of a ring mounted on the platen or in the housing. Where the ring is mounted on the platen, the abrasion resistant contact layer is arranged to contact a corresponding fixed reaction surface mounted in the housing, suitably the outer surface of the impeller shroud. Where the ring is mounted in the housing, the abrasion resistant contact layer is arranged to contact the backing face of the platen.

It is a particular advantage of the braking system according to the present invention that, where the braking means is in the form of a ring, this provides a seal between the platen and the housing, which results in improved efficiency of dust extraction.

The braking means may alternatively be in the form of one or more posts, each mounted either on the platen or in the housing. Where the brake means is in the form of a post or posts, the post or posts are preferably each mounted in a casing, more preferably in the housing, with the abrasion resistant contact layer or layers arranged to contact the backing (non-sanding) face of the sanding platen. Where the support member is in the form of a post mounted in a casing, the support member is preferably secured in the casing by means of an adhesive layer.

The braking system according to the invention is particularly suitable for use in braking a dual function powered oscillating hand tool of the type described in our co-pending UK Patent Application No 94.15011.7, when that tool is operating in the random orbit mode.

A particularly suitable material for the abrasion resistant contact layer is polytetrafluoroethylene (PTFE) brake material. For increased abrasion resistance, fillers such as carbon powder or glass can be added to the PTFE.

Particularly suitable materials for the resilient support member include natural or synthetic rubbers or synthetic foam materials such as polyethylene, polyurethane or PVC-nitrile.

A heat resistant layer may be included between the resilient material and the abrasion resistant contact layer.

Figure 2:
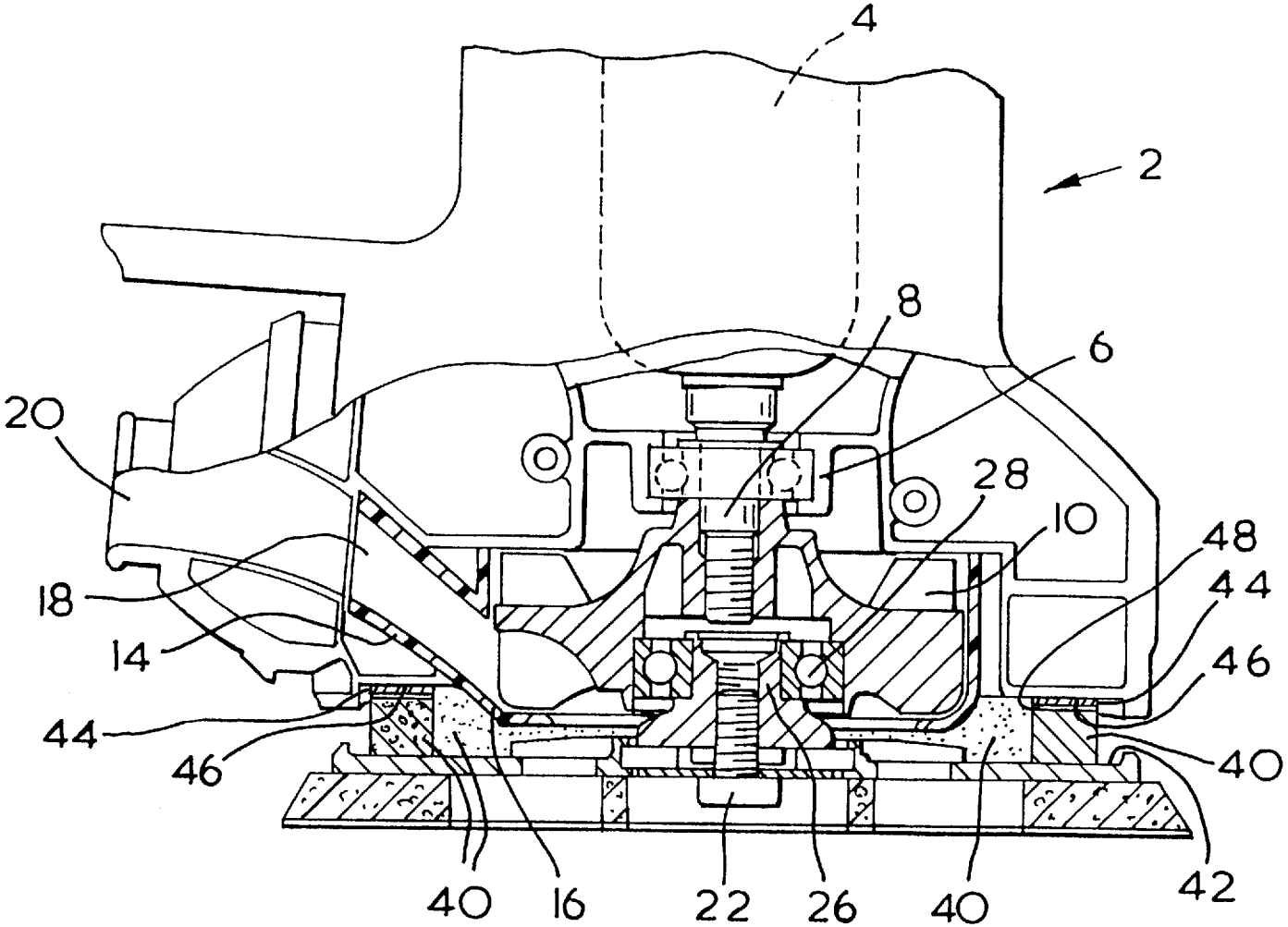

The invention will now be further described with reference to the accompanying drawings in which:

FIG. 1 is a side view, partially in section, of a first embodiment of a hand tool according to the present invention and FIG. 2 is a side view, partially in section, of a second embodiment of a hand tool according to the present invention.

FIG. 1 shows a drive unit (2) including an electric motor (4) located in upper housing (6) and driving shaft (8). A fan (10) mounted on shaft (8) is arranged to draw air in from mouth (14) of lower housing (16) and direct it through extractor duct (18) to exhaust outlet (20). A nut (22) is used to secure a sanding platen (24) to shaft (26) which is housed in the fan (10) by bearing (28) which is eccentrically located radially in respect to shaft (8).

As can be seen from FIG. 1, brake means (30) comprises a foam post (32) to which an abrasion resistant contact surface (34) is attached. A casing (36) to house the foam post (32) and abrasion resistant contact surface (34) is located in the housing (6). The foam post (32) is secured within the casing (36) by means of an adhesive layer (not shown). A reaction layer (35) on a backing face (37) of the sanding platen (24) is arranged to contact the abrasion resistant contact layer (34).

In an alternative embodiment shown in FIG. 2, a foam ring (40) is mounted on a backing face (42) of the sanding platen (24) and an abrasion resistant contact layer (44) is attached to the foam ring (40). A reaction layer (46) is provided in the housing (6) for engagement with the abrasion resistant contact layer (44).

A heat resistant layer 48 may be included between the foam post (32) and the contact layer (34) as shown in FIG. 1, and between the ring (40) and the contact layer (44) as shown in FIG. 2.

In operation, in the embodiment shown in FIG. 1, as power is supplied to the motor (4), the shaft (8) is driven in rotation and drives the shaft (26) via the eccentric bearing (28).

The shaft (8) is typically driven at a rotational speed of 12000 rpm, which is too fast a speed for rotation of the sanding platen (24). The brake means comprising the foam post (32) and abrasion resistant contact layer (34) is in constant contact with the reaction surface (35) on the backing face (42) of the sanding platen (24) and limits the rotational speed of the platen to an acceptable operating speed, typically around 1200 rpm, or 10% of the rotational speed of the motor.

Similarly, in operation of the embodiment shown in FIG. 2, as power is supplied to the motor (4), the shaft (8) is driven in rotation and drives the shaft (26) via the eccentric bearing (28).

The shaft (8) is typically driven at a rotational speed of 12000 rpm, which is too fast a speed for rotation of the sanding platen (24). The brake means comprising the foam ring (40) and abrasion resistant contact layer (44) is in constant contact with the reaction surface (46) in the housing (6) and limits the rotational speed of the platen to an acceptable operating speed, typically around 1200 rpm, or 10% of the rotational speed of the motor.

We claim:

1. A braking system for a powered oscillating hand tool, which tool comprises:

(i) a housing (6);

(ii) a drive unit (2) having an electric motor (4) and a drive shaft (8);

(iii) a bearing (28) mounted on the drive shaft (8) and located radially eccentrically relative to the drive shaft (8), adapted to drive a second drive shaft (26);

(iv) means (22) for mounting an oscillating head (24) on the second drive shaft (26); and (v) brake means (30) located, and for providing braking, between the oscillating head (24) and the housing (6) characterised in that the brake means (30) comprises:

(vi) a resilient support member (32,40) formed from a resilient material which material, under compression, provides a resultant load;

(vii) an abrasion resistant contact layer (34,44) formed as layer independent of the resilient support member (32,40) and mounted on the support member (32,40); and (viii) a reaction surface (35,46) located adjacent the contact layer (34,44) and positioned for engagement therewith as the resilient support member (32,40) is placed under compression to provide the resultant load.

2. A braking system according to claim 1 characterised in that the powered oscillating hand tool is a random orbit sander and the oscillating head is a sanding platen.

3. A braking system according to claim 2 characterised in that the braking means is in the form of a ring mounted on the platen.

4. A braking system according to claim 2 characterised in that the braking means is in the form of one or more posts, each mounted either on the platen or in the housing.

5. A braking system according to claim 4 characterised in that each post is mounted in a casing.

6. A braking system according to claim 5 characterised in that each post is mounted in a casing located in the housing.

7. A braking system according to claim 1 characterised in that the abrasion resistant contact layer is made from polytetrafluoroethylene (PTFE).

8. A braking system according to claim 1 characterised in that the resilient material is a natural or synthetic rubber or a synthetic foam material.

9. A braking system according to claim 8 characterised in that the resilient material is polyethylene, polyurethane or PVC-nitrile.

10. A braking system according to claim 1 characterised in that a heat resistant layer is located between the abrasion resistant contact layer and the resilient material.

* * * * *